US010724746B2

(12) United States Patent
Lesage

(10) Patent No.: US 10,724,746 B2
(45) Date of Patent: Jul. 28, 2020

(54) SYSTEM AND METHOD FOR PREVENTING BACTERIA PROLIFERATION IN AN ELECTRIC WATER HEATER TANK

(71) Applicant: Claude Lesage, Pointe-Claire (CA)

(72) Inventor: Claude Lesage, Pointe-Claire (CA)

( * ) Notice: Subject to any disclaimer, the term of this patent is extended or adjusted under 35 U.S.C. 154(b) by 223 days.

(21) Appl. No.: 15/932,802

(22) Filed: Apr. 27, 2018

(65) Prior Publication Data

US 2019/0331348 A1 Oct. 31, 2019

(51) Int. Cl.

| | |
|---|---|
| ***F24D 17/00*** | (2006.01) |
| ***F24H 1/18*** | (2006.01) |
| ***F24D 19/10*** | (2006.01) |
| ***F24H 9/12*** | (2006.01) |
| ***F24H 1/20*** | (2006.01) |

(52) U.S. Cl.

CPC ..... *F24D 17/0073* (2013.01); *F24D 17/0078* (2013.01); *F24D 19/1051* (2013.01); *F24H 1/181* (2013.01); *F24H 1/202* (2013.01); *F24H 9/124* (2013.01)

(58) Field of Classification Search

None

See application file for complete search history.

(56) References Cited

U.S. PATENT DOCUMENTS 3,499,423 A * 3/1970 Phlaum ..... F24H 1/205 122/14.3
3,835,880 A * 9/1974 Hoffman ..... A47L 15/0023 137/387
4,505,231 A * 3/1985 Syler ..... F24H 9/0042 122/159
4,714,053 A * 12/1987 Perry ..... F24H 9/0042 122/159
4,790,289 A * 12/1988 Barrett ..... F24H 1/18 122/17.1
4,790,291 A * 12/1988 Barrett ..... F24H 1/18 122/18.31
5,116,425 A * 5/1992 Ruef ..... B08B 3/026 134/144
5,168,546 A * 12/1992 Laperriere ..... F24D 17/0073 122/14.22
5,808,277 A * 9/1998 Dosani ..... F24D 17/0073 219/481
5,921,207 A * 7/1999 DiSalvo ..... F24H 9/0042 122/19.1

(Continued)

*Primary Examiner* — Thor S Campbell

(74) *Attorney, Agent, or Firm* — Guy J. Houle; Houle Patent Agency Inc.

(57) ABSTRACT

A system and a method for preventing bacteria growth and proliferation, and particularly the *Legionella* bacteria, in a water tank of an electric water heater is described. A small pump is mounted on the water heater and has a power rating greater than the domestic water supply. The pump is controlled by a controller to pump hot water from the upper region of the tank to the lower region of the tank. The pump is connected between the hot water outlet of the tank and the cold water inlet to which an elongated dip tube is secured and with its discharge end positioned in close proximity to the bottom wall of the tank. The controller has a timer and is programmed to pump the hot water during non-peak hours of the utility for a preset time and for a preset period of time depending on such criteria as water quality, public regulations and laws.

11 Claims, 1 Drawing Sheet

(56) References Cited

U.S. PATENT DOCUMENTS

| | | | | |
|---|---|---|---|---|
| 6,808,639 | B2 * | 10/2004 | Rawson | C02F 1/74 210/149 |
| 7,248,791 | B2 * | 7/2007 | Toth | F17C 9/02 222/3 |
| 8,596,225 | B2 * | 12/2013 | Hughes | F04D 3/00 122/14.3 |
| 10,501,338 | B2 * | 12/2019 | Lesage | F24H 1/202 |

* cited by examiner

SYSTEM AND METHOD FOR PREVENTING BACTERIA PROLIFERATION IN AN ELECTRIC WATER HEATER TANK

This application is related to U.S. patent application Ser. No. 15/731,021, filed 2017 Apr. 10 and Canadian Application No. 2,963,891, filed of 2017 Apr. 7 and entitled Method and Apparatus for Preventing Bacteria Proliferation in an Electric Water Heater.

FIELD OF THE INVENTION

The present invention relates to a system and a method for preventing bacteria proliferation, and particularly but not exclusively, the *Legionella* bacteria, in an electric water heater, by the introduction of hot water from the top of the tank into the bottom of the tank on a predetermined periodic basis as determined by a controller.

BACKGROUND OF THE INVENTION

Armful bacteria such as the *Legionella* bacteria live in water that is stagnant and it is known that such bacteria can survive under a wide range of temperatures, typically 65 to 125-130 degrees F. According to the Centers for Disease Control and Prevention, USA, between 8,000 and 18,000 people are hospitalized with Legionnaires disease each year. It is of great public concern as its fatality rate during an outbreak ranges from 5% to 30% in those who contract the disease. Actively managing the risk of *Legionella* in water systems is more cost effective than responding to an outbreak. Outbreaks of *Legionella pneumophila* can stem from showers and potable water systems. As water from such sources aerosolized, individuals can inhale the *Legionella* containing droplets and the organism is aspirated into the lungs. This risk has to be prevented in domestic water heating systems where the hot water becomes in contact with people.

The formation and multiplication of such *Legionella* bacteria is not only promoted by the temperature in the customary hot water systems, but also by the fact that dead spaces are present in such water distribution systems in which deposits and sediment formation can arise, and typically in the bottom zone of water heater tanks. Deposits therein can represent a culture medium for bacteria growth and proliferation.

Most electric water heaters for domestic use have its water tank constructed with a dome shaped bottom wall. Such dome-shaped bottom walls form a surrounding cavitated zone about the dome-shaped wall where sediments deposit can gather and where water is less agitated. This cavitated zone is spaced from the bottom heating element and thus water therein is less hot creating an ideal location for bacterial proliferation. Should the bottom element fail, then the water temperature at the bottom of the tank will drop. When hot water is not drawn from a water heater, the water inside the tank becomes stagnant and the water temperature stratifies with the cooler temperature being at the bottom region of the tank. Water below the bottom element of the tank can fall to about 85 to 100 degrees F. which is favourable to bacteria growth. Lowering the bottom element to place it close to the bottom wall of the tank has not proven to be a viable solution.

Reference is made to U.S. Pat. Nos. 4,940,024; 5,168,546 and 5,808,277 which disclose various methods and apparatus to prevent bacteria proliferation in electric water heaters. One method teaches adding a heating element in the form of a belt or patch on the outside of the tank against the bottom end of the outer sidewall of the tank to heat the water at the bottom end of the tank to a temperature preferably above 130 degrees F. Accordingly, this proposed solution provides an extra heating element in the form of a patch heater located in an area which is usually filled with insulating foam material and not practical to access should it fail and require replacement or repair. It is also costly and consumes more electricity. In U.S. Pat. No. 5,808,277 a third heating element is added into the tank to periodically raise the water temperature at the bottom of the tank beyond the pre-set consumption temperature, to a sanitizing temperature to destroy bacteria. This is also a costly proposition. U.S. Pat. No. 4,940,024 discloses a method of directing the cold water flow of all consumed drinking or domestically used water through the lower region of the tank wherein there is no stagnant water and wherein no deposits can be formed for bacteria growth. Accordingly, the lower region of the tank is continuously flushed with fresh water. This is a costly solution requiring a new tank design and cold water conduit network and therefore also not a viable solution.

SUMMARY OF THE INVENTION

It is a feature of the present invention to provide a system and method for the prevention of armful bacteria, and particularly the *Legionella* bacteria in a tank of an electric water heater and which system and method is different from the known prior art and which use hot water within the top part of the water tank to elevate the temperature of the water in the lower part of the tank sufficiently high to kill and prevent growth and proliferation of bacteria.

Another feature of the present invention is to provide a pump which is controlled by a programmed controller for periodic operation of the pump whereby to pump hot water from the upper region of the tank to the bottom end to maintain the temperature in the bottom end of the tank at a temperature sufficiently high to prevent bacteria growth.

According to the above features, from a broad aspect, the present invention provides an electric water heater comprising a tank defined by a cylindrical side wall, a top wall and a bottom wall. A cold water inlet is secured to a dip tube which extends in the tank to release cold water under pressure in a lower portion of the tank. A hot water outlet supplies hot water to a hot water distribution conduit. Two or more resistive heating elements heat water in a respective one of an upper and lower region of the tank. Controls having temperature sensors associated with the resistive heating elements is provided for sensing water temperature in the upper and lower regions of the tank and to actuate and de-actuate at least one of the resistive heating elements when the water temperature in at least one of the tank regions falls below a set point temperature value as sensed by the sensors. A pump controlled by a programmed controller is provided to cause heated water from the upper region of the tank to be transferred and released in the lower region of the tank in close proximity to the bottom wall at a preset time and for a preset period of time as determined by the pump controller and at a temperature sufficient to kill and prevent bacteria growth adjacent the bottom wall.

According to the broad aspect mentioned above, the pump has a pressure rating greater than the water pressure of the cold water inlet. The water pump has an inlet end connected to the tank hot water conduit and an outlet end connected to the cold water inlet of the tank to release hot water from the upper region of the tank into the lower region in the immediate area of the bottom wall and into a cavitated zone to raise the water temperature therein.

According to a still further broad aspect of the present invention, there is provided a method of preventing bacterial growth in a bottom end of a water holding tank of an electric water heater. The method comprises mounting a pump on the water heater by connecting an inlet of the pump to the hot water supply conduit and connecting an outlet of the pump to the cold water inlet of the tank. The pump has a pressure rating greater than the domestic water supply connected to the cold water inlet of the tank. An elongated dip tube is mounted in the tank and to which the cold water inlet is connected to. programming a universal time clock of a controller which operates a water pump at a preset time and for a preset period of time. The pump is operated convect heated water from the upper region of the tank to the immediate area of the bottom wall to maintain the temperature in the immediate area at a temperature sufficiently high to prevent harmful bacteria growth.

DESCRIPTION OF THE DRAWINGS

A preferred embodiment of the present invention will now be described with reference to the examples of the preferred embodiment wherein.

DESCRIPTION OF THE PREFERRED EMBODIMENT OF THE INVENTION

Figure 1:
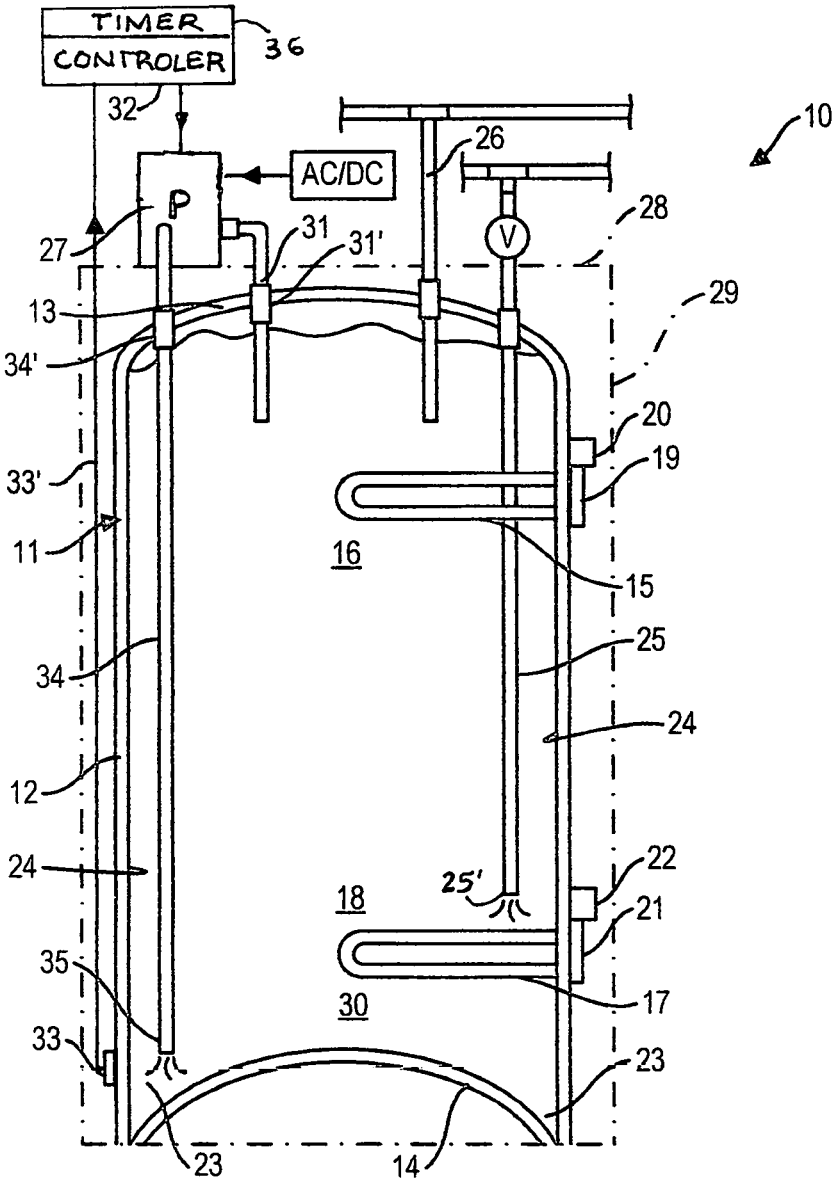
FIG. 1 is a simplified section view of an electric water heater tank showing some of the components thereof and wherein a water pump, operated by a controller, displaces hot water from the top region of the tank to the lower region thereof closely spaced above the bottom wall of the tank and wherein the bottom wall of the tank has a dome shape.
Figure 2:
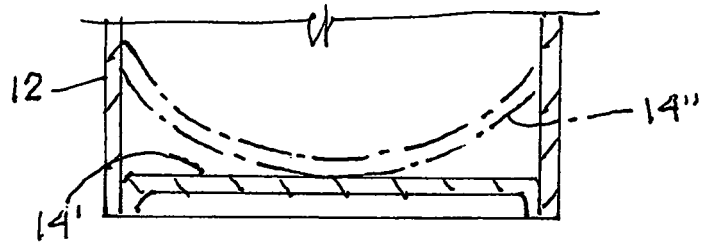
FIG. 2 is a fragmented cross-sectional side view illustrating a tank with a flat or concave bottom wall.

Referring to FIGS. 1 and 2, there is shown generally at 10 an electric water heater which is comprised of a water holding steel tank 11 formed by a surrounding side wall 12, a top wall 13 and a dome-shaped bottom wall 14. The bottom wall may be a flat bottom wall 14', as shown in FIG. 2, and may have other shapes, such as a concave bottom wall, as shown in phantom lines 14". A resistive heating element 15 is mounted to the tank side wall and projects in an upper region 16 of the tank 12. A bottom resistive heating element 17 is also mounted to the tank wall 14 and projects into a lower region 18 of the tank spaced above the bottom wall 14. A control thermistor 19 is equipped with a temperature sensor 20 and operates the resistive heating element 15 to maintain a set temperature value in the upper region 16 of the tank. Similarly, a control thermistor 21 and temperature sensor 22 control the lower resistive heating element 17 and set at the same temperature as the upper element. Typically, during ordinary operating conditions the consumption temperature of the water in the tank upper region 16 is at 140 degrees F.

As previously described, the *Legionella* bacteria can survive in stagnant water at temperatures of 65 to about 130 degrees F. but above these temperatures the bacteria is destroyed. Because the tank bottom wall 14 is shaped as a dome, as shown in FIG. 1, it defines a surrounding cavitated zone 23 about the dome adjacent the tank side wall inner surface 24 wherein sediments in the water can build up to form a culture bed for bacteria growth as the water therein is less agitated by the movement of water in the tank. Water in the tank lower end is disturbed as the water is heated and rises in the tank. Also as hot water is removed from the upper region 16, through the outlet pipe 26, cold water is drawn into the tank through the dip tube 25 bottom end 25' spaced above the bottom wall and causes water agitation and any sediment will precipitate into the cavitated zone due to the dome shape of the bottom wall. In order to prevent the proliferation of the *Legionella* bacteria in the bottom end 30 of the tank below the lower resistive heating element 17 and particularly in the cavitated zone 23, the present invention provides a water pump 27 having a pressure rating greater than that of the domestic water supply. The pump is conveniently mounted on the top wall 28 of the outer shell 29 of the tank 11. The pump has a rating of 150 psi and has an inlet conduit 34 connected to the hot water supply conduit 31 of the tank, and an outlet conduit 35 connected to the dip tube 25 through coupling 25' whereby to pump hot water from the upper region 16 of the tank, where the water is hottest at 140 degrees F., to the bottom end 30 of the tank in close proximity to the bottom wall 14, 14', 14".

Because the pump 27 is connected to existing conduits of the water heater tank 10, it can be easily installed on existing electric water heaters as a retrofit. It is also pointed out that because the pressure of a domestic water supply is usually between 35 to 50 psi, the pressure of 150 psi of the pump 27 will overpower the domestic supply to the water inlet of the dip tube. As shown in FIG. 1, the dip tube 25 is an extended dip tube whereby its outlet end 38 is positioned in the immediate area and closely spaced from the bottom wall 14, and as herein shown, above the cavitated circumferential area 23 where bacteria could form.

As shown in FIG. 1, the pump 27 is controlled by a controller device 32. The controller 32 has a programmable universal timer 36 which is programmed to operate the pump 27 for a predetermined time period at a specific hour of the day, during non-peak hours of the utility, when electricity cost is at its lowest. The pump is operated during non-peak hours of the utility. These timer settings can vary from different locations depending on water quality and local municipality public health regulations and laws. For example, some municipalities where water quality is high, the tank sanitation may require a cycle only every two or three days and for a short period of time, such as 30 minutes and during non-peak hours. Hot water is released from the discharged end 36 of the dip tube 25 on a periodic basis to insure that there are no surviving armful bacteria in the bottom end of the tank as a bacteria like the *Legionella* would die immediately upon contact with hot water above 135 degrees F.

As herein illustrated, a temperature detector 33 is mounted on the tank wall to sense the temperature of the water in the lower region of the tank and feeds temperature signals to the controller 32. The controller 32 is programmed to monitor this temperature signal to ensure that the bottom end of the tank was at a temperature of at least 135 degrees F. for the programmed period of time and if not, the pump would continue operation until that predetermined period of time has been achieved.

It is to be noted that by connecting the outlet conduit 35 of the pump 27 directly to the dip tube 25 which extends in the tank in contact with hot water therein, there is substantially no heat loss in the transfer of hot water from the upper region 16 to the bottom end 30 of the tank. The dip tube 25 is also constructed from non-oxidation material, similar to the dip tube 25 and capable of withstanding temperatures well above 140 degrees F. and the pressure of the pump 27 The hot water conduit 31 and the dip tube connection conduit 25" are removably secured to the top wall 13 of the tank through suitable quick couplings 31' and 25', such as cash-acme couplings known by the trade name "SHARK BITE", which is a registered trademark.

It is within the ambit of the present invention to cover any obvious modifications of the preferred embodiment described herein provided such modifications fall within the scope of the appended claims.

The invention claimed is:

1. An electric water heater comprising a tank defined by a cylindrical side wall, a top wall and a bottom wall; a cold water inlet is secured to a dip tube extending in said tank for releasing cold water under pressure in a lower portion of said tank, a hot water outlet conduit for supplying hot water to a hot water distribution conduit, two or more resistive heating elements for heating water in a respective one of an upper and lower region of said tank, a control having a temperature sensor is associated with each of said resistive heating elements to sense water temperature in said upper and lower regions of said tank and to actuate and de-actuate said two or more resistive heating elements when water temperature in at least one of the tank regions falls below a set point temperature value as sensed by said sensors, a pump having an inlet secured to said hot water outlet conduit which extends into the upper region of said tank where water is at its hottest temperature, said pump having an outlet connected to said dip tube, said dip tube having a discharge end terminating in close proximity to said tank bottom wall, said pump operating at a pressure rating greater than a domestic water supply connected to said cold water inlet, said pump being controlled by a programmed controller to transfer heated water from said tank upper region to said tank lower region in close proximity to said bottom wall at a preset time and for a preset period of time as determined by said controller and at a temperature sufficient to kill and prevent bacteria growth adjacent said bottom wall.

2. The electric water heater as claimed in claim 1 wherein said bottom wall of said tank is a dome shaped bottom wall defining a circumferential cavitated region adjacent said cylindrical side wall in which sediments deposit to form a sedimentary culture bed in which bacteria can develop and proliferate.

3. The electric water heater as claimed in claim 1 wherein said bottom wall of said tank is a flat or concave bottom wall.

4. The electric water heater as claimed in claim 1 wherein said controller incorporates therein a universal clock which is programmed to automatically operate said pumps at said preset time and for said preset period of time.

5. The electric water heater as claimed in claim 1 wherein said pump has a pressure rating of 150 psi.

6. The electric water heater as claimed in claim 1 wherein said dip tube is constructed of non-oxidation material and capable of withstanding temperatures well above 140 degrees F. and pressures of at least 150 psi.

7. The electric water heater as claimed in claim 1 wherein said cold water inlet conduit and said hot water outlet conduit are connected to an upper wall of said tank by quick couplings of the cash-acme type known by the trademark "SHARK BITE".

8. The electric water heater as claimed in claim 1 wherein there is further provided a temperature sensor mounted on the outer surface of the tank adjacent said lower region to feed temperature signals to said controller representative of the water temperature in the tank adjacent said temperature sensor, said controller maintaining said pump operational beyond said preset period of time if said water temperature has not reached a temperature of 135 degrees F. or more and maintained said temperature during said preset period of time.

9. A method of preventing bacteria growth in a bottom end region of a water holding tank of an electric water heater, said method comprising the step of:

i) mounting a pump on said water heater by connecting an inlet of said pump to a hot water supply conduit of said tank and connecting an outlet of said pump to a cold water inlet of said tank, said pump having a pressure rating greater than a domestic water supply connected to said cold water inlet, and wherein an elongated dip tube is mounted in said tank and to which said cold water inlet is connected to, ii) programming a time clock of a controller to operate said water pump mounted on said water heater to pump water from an upper region of said tank to a lower region of said tank and for a preset time and for a preset period of time at predetermined day intervals.

10. The method as claimed in claim 8 wherein said water in said upper region of said tank is at a temperature in the range of 140 degrees F. and wherein within said preset time the water in said lower region of said tank has attained a temperature of at least 130 to 135 degrees F. for said preset period of time which is sufficient to kill harmful bacteria.

11. The method as claimed in claim 8 wherein said pump circulates hot water from said upper region of said tank to said lower region at a rate of about 150 psi to overpower the pressure of said domestic water supply which is also connected to said inlet end of said cold water inlet.

* * * * *